US008662418B1

(12) United States Patent
Ferrante

(10) Patent No.: US 8,662,418 B1
(45) Date of Patent: Mar. 4, 2014

(54) SOAP DISPENSING SHOWERHEAD SYSTEM

(76) Inventor: Peter M. Ferrante, Rockport, MA (US)

( * ) Notice: Subject to any disclaimer, the term of this patent is extended or adjusted under 35 U.S.C. 154(b) by 280 days.

(21) Appl. No.: 13/308,744

(22) Filed: Dec. 1, 2011

(51) Int. Cl.
*B05B 7/26* (2006.01)

(52) U.S. Cl.
USPC ..... 239/314; 239/310; 239/332; 239/418; 239/423; 239/549; 239/587.1; 4/605; 4/903

(58) Field of Classification Search
USPC ..... 239/310, 312, 314, 318, 418, 423, 424, 239/443, 446, 549, 587.1, 587.4; 4/605, 4/903
See application file for complete search history.

(56) References Cited

U.S. PATENT DOCUMENTS 3,174,691 A * 3/1965 Haviland ..... 239/314
3,446,438 A * 5/1969 Watson ..... 239/312
4,607,793 A * 8/1986 Eberle ..... 239/318
D326,896 S 6/1992 McNeely
5,356,076 A 10/1994 Bishop
6,749,135 B2 * 6/2004 Groblebe et al. ..... 239/314
6,926,212 B1 8/2005 Glass
2006/0011746 A1 1/2006 De Simone
2008/0169359 A1 7/2008 Carrubba et al.
2010/0213279 A1 8/2010 Frederick

* cited by examiner

*Primary Examiner* — Steven J Ganey

(57) ABSTRACT

A showerhead system for dispensing soap and water simultaneously having a reservoir with an inner cavity for holding a material, a first and second opening are each in the reservoir providing access to the inner cavity, a reservoir hose extending from the second opening into the inner cavity, a pump fluidly connected to the reservoir hose having a switch activating and deactivating the pump, a connector hose fluidly connected to the pump, and a showerhead having an inner cavity and a connector base for fluidly connecting to a main water line in.

7 Claims, 3 Drawing Sheets

Side View

Cross Section Shower Head

Side View

Cross Section Shower Head

Shower Nozzle

Cross Section of Container

Isometric of Container

SOAP DISPENSING SHOWERHEAD SYSTEM

FIELD OF THE INVENTION

The present invention is directed to a modified showerhead that dispenses soap into a stream of water allowing both water and soap to be simultaneously sprayed onto an individual in a shower.

BACKGROUND OF THE INVENTION

Many individuals find themselves searching for a bar of soap in the shower. In some cases, the soap can slip under the individual's foot, causing him/her to slip. The present invention features a novel soap dispensing showerhead system for dispensing liquid soap into the water stream, allowing soap and water to be sprayed simultaneously onto the user in the shower.

SUMMARY

The present invention features a soap dispensing showerhead system. In some embodiments, the showerhead system for dispensing soap and water simultaneously, comprises a reservoir having an inner cavity for holding a material, a first opening and a second opening are each disposed in the reservoir providing access to the inner cavity of the reservoir; a reservoir hose extending from the second opening into the inner cavity of the reservoir; a pump fluidly connected to the reservoir hose, the pump comprises a switch that can move between at least a first position activating the pump and a second position deactivating the pump; a connector hose fluidly connected to the pump; and a showerhead having an inner cavity and a connector base for fluidly connecting to a main water line in a standard manner, wherein water from the main water line enters the inner cavity and is sprayed out of the inner cavity via water holes disposed in a front surface of the showerhead, a showerhead hose is disposed in the inner cavity of the showerhead, the showerhead hose is fluidly connected to the connector hose and to the front surface of the showerhead; wherein when activated the pump pumps the material from the reservoir through the reservoir hose through the connector hose through the showerhead hose and through soap holes disposed in the showerhead.

In some embodiments, the material is liquid soap. In some embodiments, the system further comprises a cap removably attached to the first opening. In some embodiments, the openings are each disposed in a top of the reservoir. In some embodiments, the reservoir hose is fluidly connected to a first threaded stem disposed in the second opening of the reservoir. In some embodiments, the pump is connected to the first threaded stem in the second opening. In some embodiments, the connector hose is connected to the pump via a second threaded stem.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
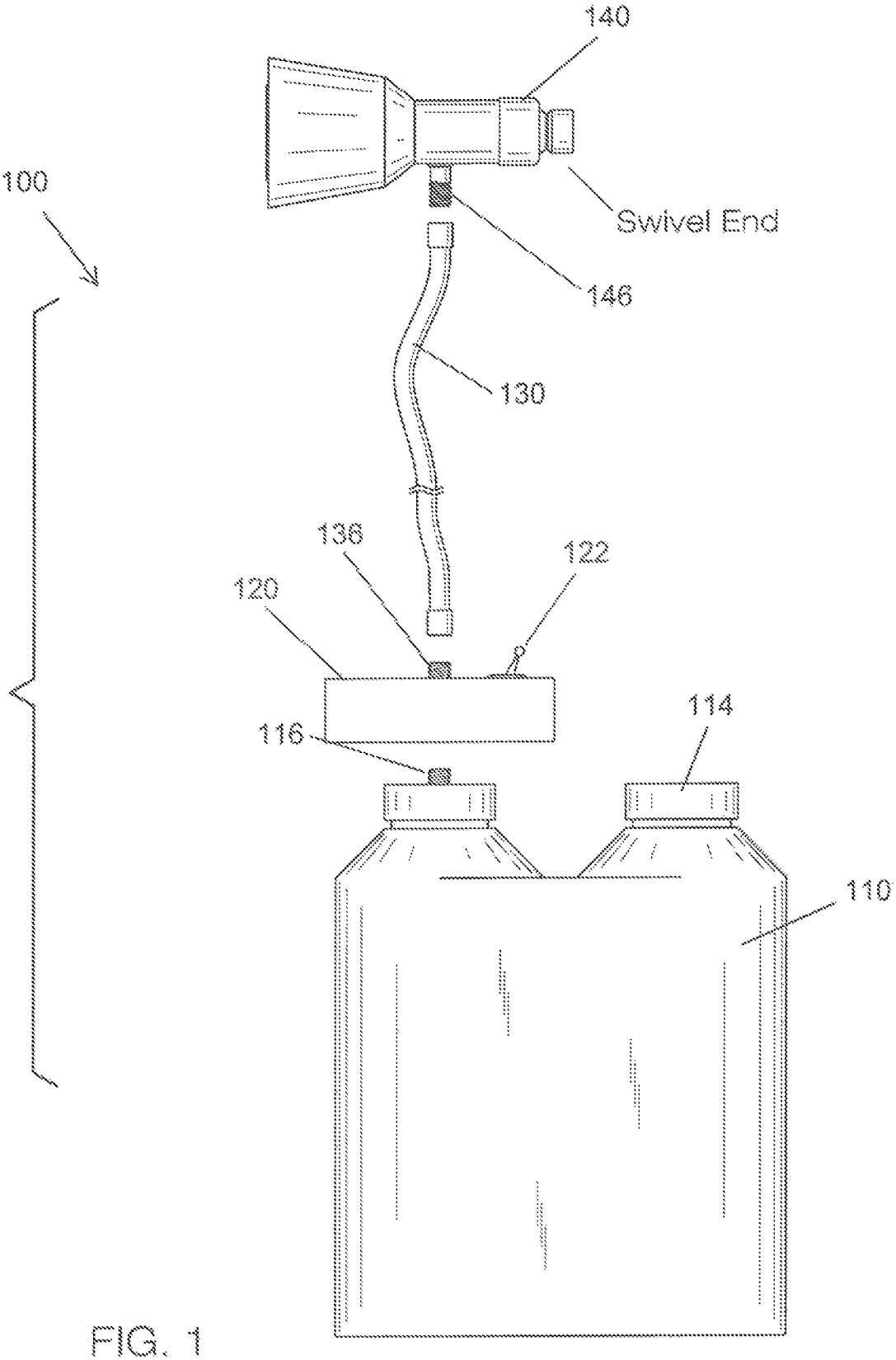
FIG. 1 is a side view of the system of the present invention.
Figure 3:
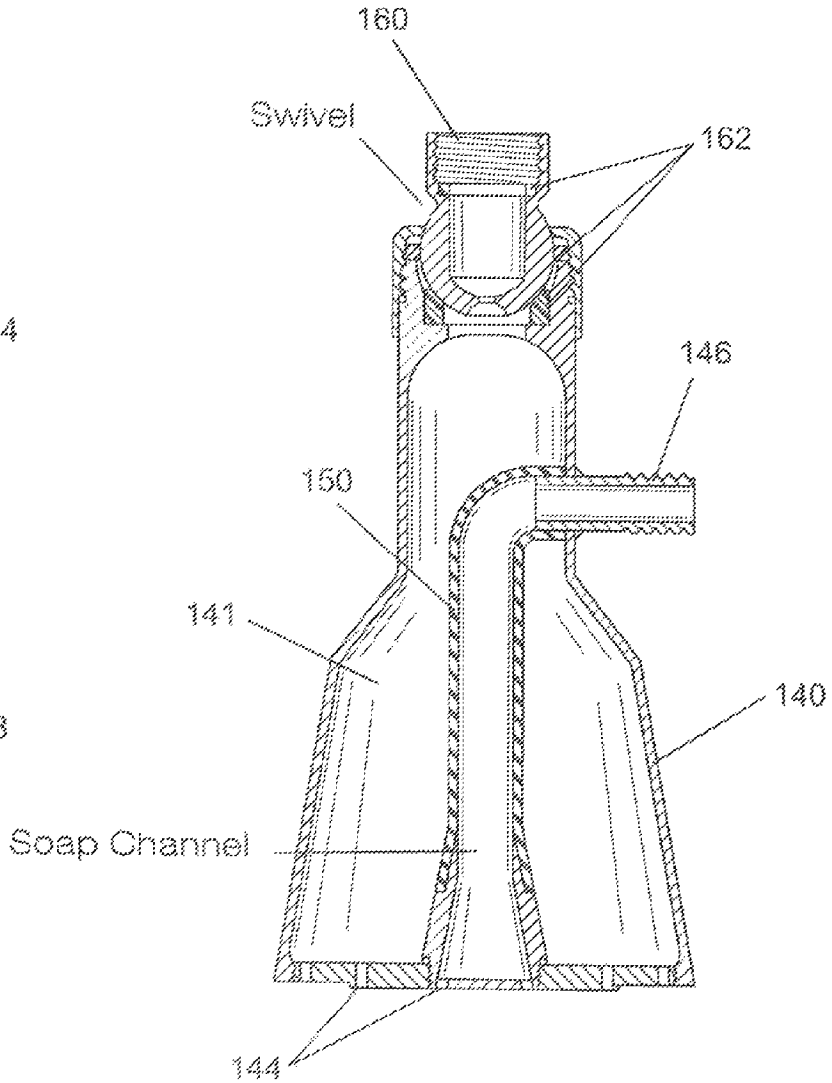
FIG. 3 is a side cross sectional view of the system of the present invention.
Figure 2:
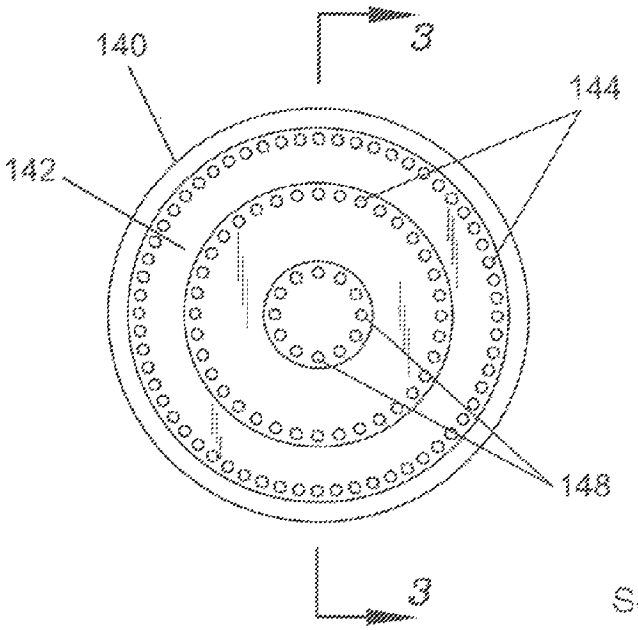
FIG. 2 is a front view of the system of the present invention.
Figure 5:
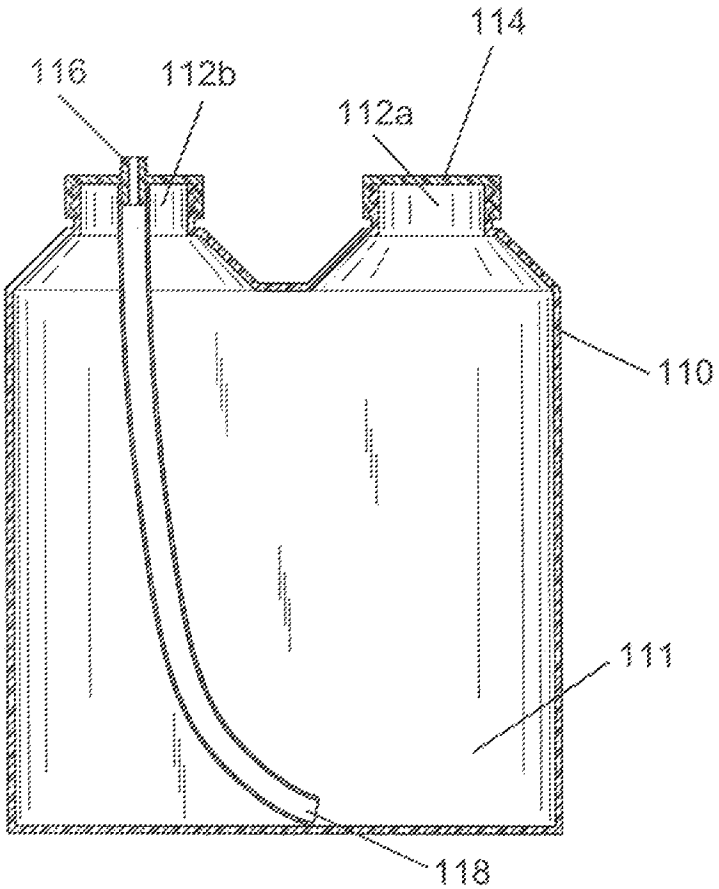
FIG. 5 is a side cross sectional view of the system of the present invention.
Figure 4:
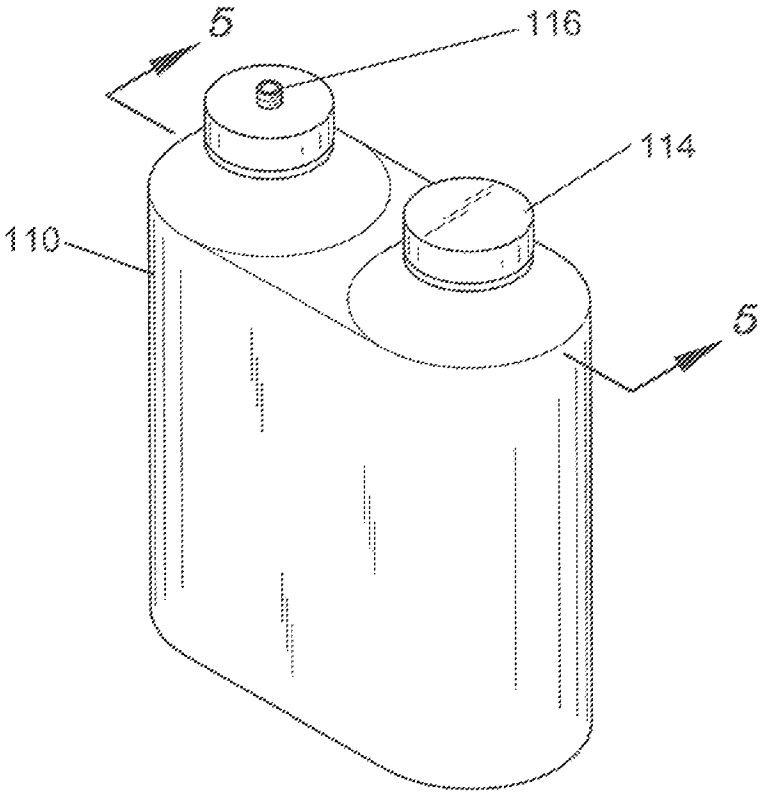
FIG. 4 is a perspective view of the system of the present invention.

Referring now to FIG. 1-5, the present invention features a soap dispensing showerhead system 100. The system 100 comprises a reservoir 110 having an inner cavity 111 for holding a material such as liquid soap. The reservoir 110 has a first opening 112*a* and a second opening 112*b* for providing access to the inner cavity 111 of the reservoir 110. As shown in FIG. 1, FIG. 4, and FIG. 5, the openings 112 are disposed in the top of the reservoir 110, however the reservoir 110 is not limited to this configuration. A cap 114 is removably attached to the first opening 112*a*. In some embodiments, a first threaded stem 116 is disposed in the second opening 112*b*. A reservoir hose 118 extends from second opening 112*b* into the inner cavity 111 of the reservoir 110 as shown in FIG. 5. In some embodiments, the reservoir hose 118 is fluidly connected to the first threaded stem 116. The first opening 112*a* may be used for refilling the reservoir 110.

In some embodiments, the reservoir 110 is installed in the shower wall.

A pump 120 is fluidly connected to the reservoir hose 118 of the reservoir 110 and to a connector hose 130. In some embodiments, the pump 120 is connected to the first threaded stem 116 in the second opening 112*b*. In some embodiments, the connector hose 130 is connected to the pump 120 via a second threaded stem 136. Pumps 120 are well known to one of ordinary skill in the art. The pump 120 is adapted to pump the material (e.g., liquid soap) out of the reservoir 110 via the reservoir hose 118 and through the connector hose 130. The pump 120 comprises a switch 122, wherein the switch 122 can move between a first position activating the pump 120 and a second position deactivating the pump 120.

The system 100 further comprises a showerhead 140. Showerheads are well known to one of ordinary skill in the art. The connector hose 130 is fluidly connected to a showerhead 140, e.g., to a third threaded stem 146 disposed on the showerhead 140. For example, the connector hose 130 is fluidly connected to a showerhead hose 150 disposed in the inner cavity 141 of the showerhead 140. In some embodiments, as shown in FIG. 3, the third threaded stem 146 is fluidly connected to the showerhead hose 150.

The showerhead 140 further comprises a connector base 160 that connects to the main water line. The connector base 160 allows water into the inner cavity 141 of the showerhead 140. In some embodiments, the connector base 160 is pivotally engaged with the showerhead 140 such that the showerhead 140 can swivel. In some embodiments, the connector base 160 is surrounded by one or more gaskets 162, which help to provide a leak-proof connection between the connector base 160 and the showerhead 140.

Disposed on the front surface 142 of the showerhead 140 are a plurality of water holes 144 which allow water from the inner cavity 141 of the to spray out of the showerhead 140.

The showerhead hose 150 extends to the front surface 142 of the showerhead 140. A plurality of soap holes 148 is disposed in the front surface 142 of the showerhead 140 aligned with the showerhead hose 150. The soap holes 148 allow soap to be dispensed.

Without wishing to limit the present invention to any theory or mechanism, it is believed that the system 100 of the present invention is advantageous because it allows the mixing of the soap and water after the two have exited the showerhead. This allows the water in the showerhead to remain clean when the pump 120 is off.

The disclosures of the following U.S. Patents are incorporated in their entirety by reference herein: U.S. Pat. No. 5,356,076; U.S. Design Pat. No. D326896; U.S. Pat. No. 6,926,212; U.S. Patent Application No. 2006/0011746; U.S. Patent Application No. 2008/0169359; U.S. Patent Application No. 2010/0213279.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A showerhead system (100) for dispensing soap and water simultaneously, said showerhead system (100) comprising:

(a) a reservoir (110) having an inner cavity (111) for holding a material, a first opening (112*a*) and a second opening (112*b*) are each disposed in the reservoir (110) providing access to the inner cavity (111) of the reservoir (110);

(b) a reservoir hose (118) extending from the second opening (112*b*) into the inner cavity (111) of the reservoir (110);

(c) a pump (120) fluidly connected to the reservoir hose (118), the pump (120) comprises a switch (122) that can move between at least a first position activating the pump (120) and a second position deactivating the pump (120);

(d) a connector hose (130) fluidly connected to the pump (120); and (e) a showerhead (140) having an inner cavity (141) and a connector base (160) for fluidly connecting to a main water line in a standard manner, wherein water from the main water line enters the inner cavity (141) and is sprayed out of the inner cavity via water holes (144) disposed in a front surface (142) of the showerhead (140), a showerhead hose (150) is disposed in the inner cavity (141) of the showerhead (140), the showerhead hose (150) is fluidly connected to the connector hose (130) and to the front surface (142) of the showerhead (140);

wherein when activated the pump (120) pumps the material from the reservoir (110) through the reservoir hose (118) through the connector hose (130) through the showerhead hose (150) and through soap holes (148) disposed in the showerhead (140).

2. The system (100) of claim 1, wherein the material is liquid soap.

3. The system (100) of claim 1 further comprising a cap (114) removably attached to the first opening (112*a*).

4. The system (100) of claim 1, wherein the openings (112) are each disposed in a top of the reservoir (110).

5. The system (100) of claim 1, wherein the reservoir hose (118) is fluidly connected to a first threaded stem (116) disposed in the second opening (112*b*) of the reservoir (110).

6. The system (100) of claim 5, wherein the pump (120) is connected to the first threaded stem (116) in the second opening (112*b*).

7. The system (100) of claim 1, wherein the connector hose (130) is connected to the pump (120) via a second threaded stem (136).

* * * * *